US006517159B1

(12) United States Patent
Wu

(10) Patent No.: US 6,517,159 B1
(45) Date of Patent: Feb. 11, 2003

(54) SUPPORT ASSEMBLY FOR A FORWARDLY DECLINED ARMREST

(76) Inventor: Hsiu-Hsueh Wu, No. 12, Lane 198, Ta Li Second Street, Ta Li City, Taichung Hsien (TW)

( * ) Notice: Subject to any disclaimer, the term of this patent is extended or adjusted under 35 U.S.C. 154(b) by 0 days.

(21) Appl. No.: 10/000,053

(22) Filed: Nov. 1, 2001

(51) Int. Cl.[7] ..... A47C 5/04
(52) U.S. Cl. ..... 297/411.44
(58) Field of Search ..... 297/411.2, 411.44; 248/118

(56) References Cited

U.S. PATENT DOCUMENTS 1,088,385 A * 2/1914 Wanner, Jr.
2,459,033 A * 1/1949 Kraus
D169,818 S * 6/1953 Krikorian
2,661,049 A * 12/1953 Sebel
2,699,200 A * 1/1955 Lingle
6,033,013 A * 3/2000 Lee
6,341,821 B1 * 1/2002 Rousseau

* cited by examiner

*Primary Examiner*—Milton Nelson, Jr.
(74) *Attorney, Agent, or Firm*—Alan D. Kamrath; Rider, Bennett, Egan & Arundel

(57) ABSTRACT

A support includes a first portion securely fixed to an armrest that declines forward. The support further includes a second portion extending at a level above a lower front end of the armrest. The elbows of the user using a computer keyboard or the like are supported by the support, thereby avoiding the risk of sore arms and/or shoulders as a result of long-term typing or the like.

3 Claims, 5 Drawing Sheets

SUPPORT ASSEMBLY FOR A FORWARDLY DECLINED ARMREST

BACKGROUND OF THE INVENTION

1. Field of the Invention

The present invention relates to a support assembly for a forwardly declined armrest of a chair.

2. Description of the Related Art

Some chairs use metal armrests to provide an aesthetically pleasing effect. For this purpose, the metal armrests are made to decline forwardly, rather than having an L-shape. FIG. 6 of the drawings illustrates a conventional chair 10 comprising a backrest 12, a seat 11, and two armrests 13 that decline forwardly. However, the armrests 13 could not provide adequate support to the elbows of a user using a computer keyboard. The user's arms and/or shoulders often become sore as a result of long-term typing.

SUMMARY OF THE INVENTION

An object of the present invention is to provide a support assembly for a forwardly declined armrest of a chair. The support assembly provides a support for the elbows of a user using a computer keyboard or the like.

The present invention provides a combination of an armrest of a chair and a support assembly. The combination comprises an armrest declining forward and having an upper rear end and a lower front end. The combination further comprises a support comprising a first portion securely fixed to the armrest and a second portion extending at a level above the lower front end of the armrest. The elbows of the user using a computer keyboard or the like are supported by the support, thereby avoiding the risk of sore arms and/or shoulders as a result of long-term typing or the like.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
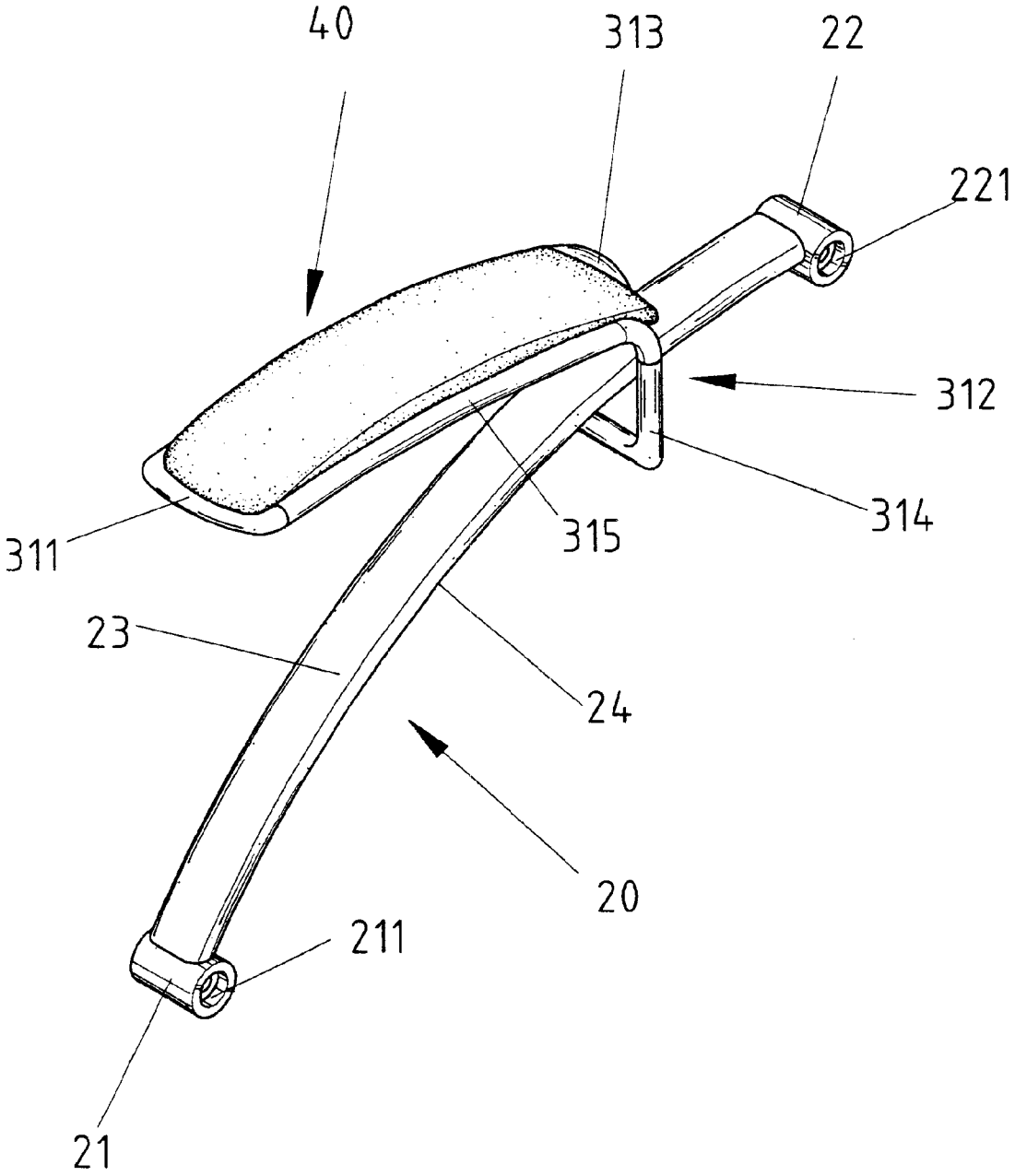
FIG. 1 is an armrest and a support assembly for the armrest in accordance with the present invention.
Figure 2:
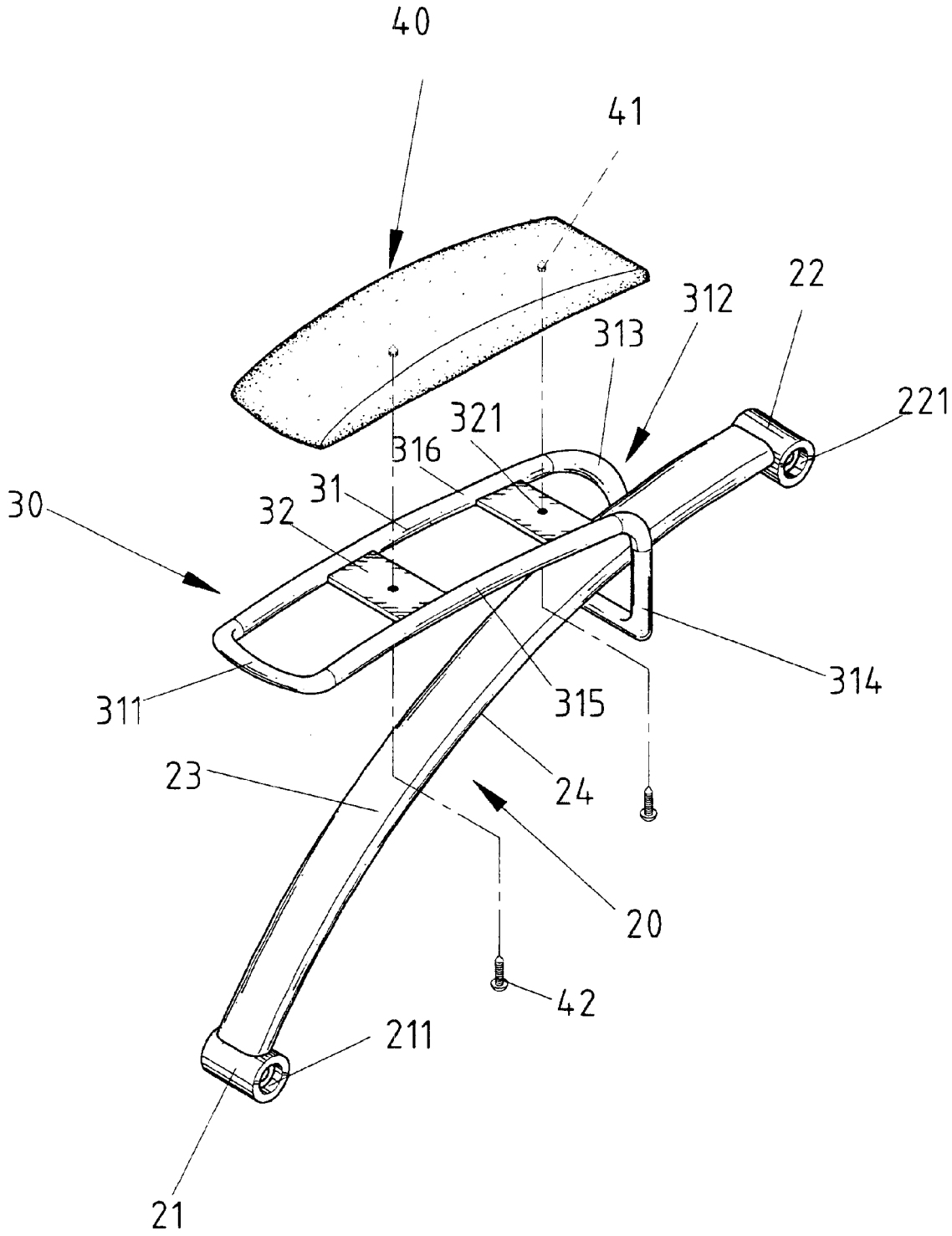
FIG. 2 is an exploded perspective view of the armrest and the support assembly in FIG. 1.

Referring to FIGS. 1 through 5 and initially to FIGS. 1 and 2, the present invention provides a support assembly for an armrest 20 that declines forwardly. The support assembly comprises a support 30 and an arm pad 40. The armrest 20 comprises an arcuate underside 24 and an arcuate upper side 23. In addition, the armrest 20 comprises an upper rear end 22 having a transverse engaging hole 221 and a lower front end 21 having a transverse engaging hole 211. The upper rear end 22 of the armrest 20 is attached to a side of a backrest 50 (FIG. 3) of a chair, and the lower front end 21 of the armrest 20 is attached to a side of a seat 51 of the chair.

The support 30 is substantially rectangular and comprises a first end 311 and a second end. In this embodiment, the support 30 is a rectangular frame 31 having the first end 311, and the second end of the frame 31 comprises two L-shaped members 313 and 314, wherein the horizontal section (not labeled) of each L-shaped member 313, 314 is securely fixed (such as by soldering) to the underside 24 of the armrest 20, and wherein the armrest 20 is located between the vertical sections of the L-shaped members 313 and 314.

Figure 3:
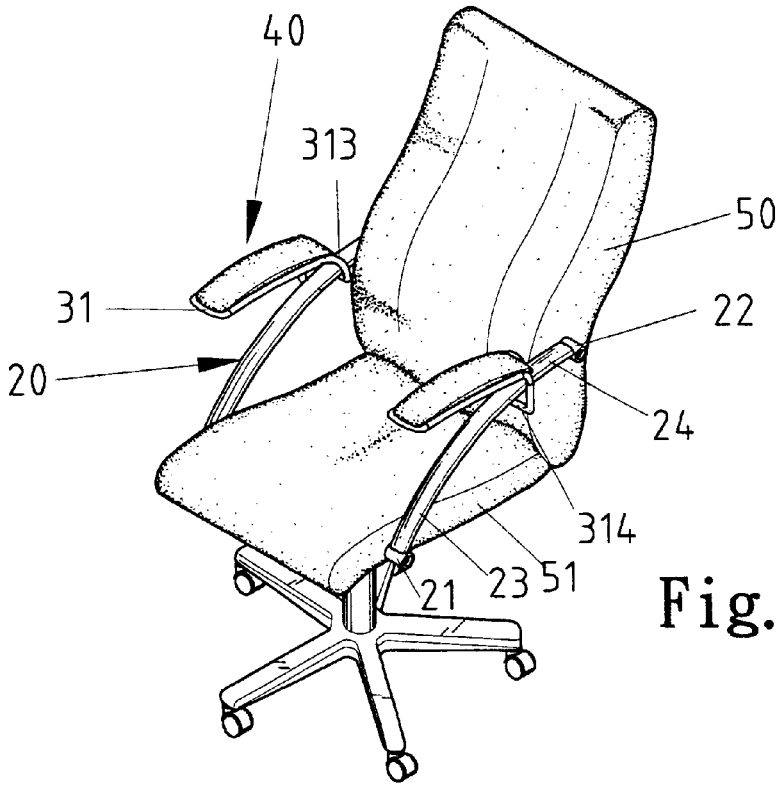
FIG. 3 is a perspective view of a chair using the support assembly in accordance with the present invention.

The frame 31 further comprises two parallel connecting beams 315 and 316. The connecting beam 315 connects an end portion of the first end 311 of the frame 31 to the vertical section of the L-shaped member 314. The connecting beam 316 connects the other end portion of the first end 311 of the frame 31 to the vertical section of the L-shaped member 313. The connecting beams 315 and 316 extend at a level higher than the lower front end 21 of the armrest 20. At least one fixed plate 32 is securely attached between the connecting beams 315 and 316. In this embodiment, there are two fixed plates 32 on which the arm pad 40 is mounted. Screws 42 are extended through holes 321 in the fixed plates 32 and into screw holes 41 in an underside of the arm pad 40. Thus, as illustrated in FIG. 3, the arm pad 40 provides a support for the elbows of the user using a computer keyboard or the like, thereby avoiding the risk of sore arms and/or shoulders as a result of long-term typing or the like. The arm pad 40 may be omitted if the fixed plates 32 are made of soft material and located at a level high enough to support the elbows of the user.

Figure 4:
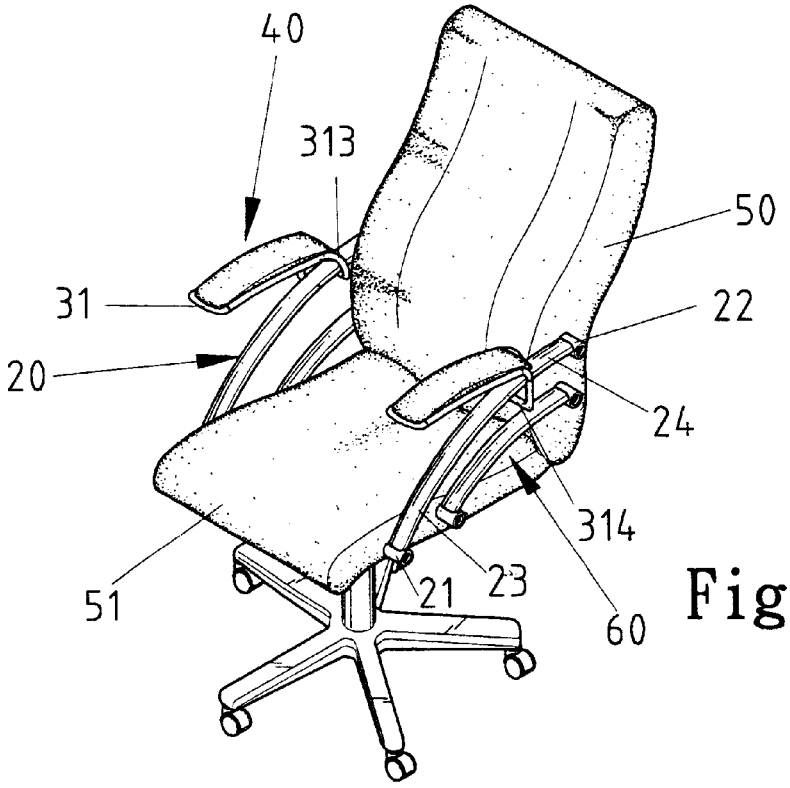
FIG. 4 is a perspective view illustrating a modified embodiment of the present invention.

FIG. 4 illustrates a modified embodiment of the invention, wherein an auxiliary support 60 is mounted below the armrest 20 and has two ends respectively attached to the backrest 50 and the seat 51.

Figure 5:
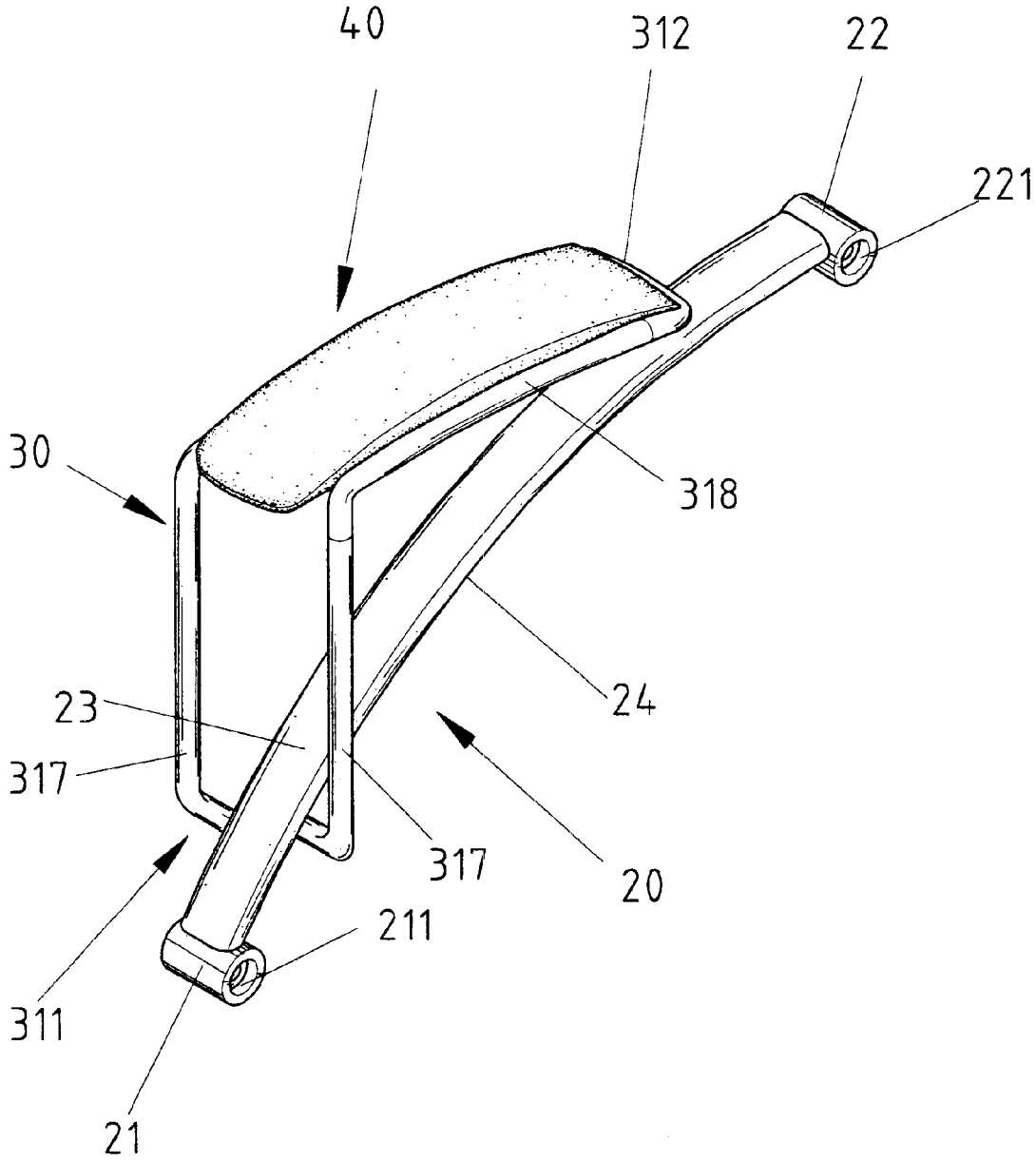
FIG. 5 is a perspective view of an armrest and a modified embodiment of the support assembly in accordance with the present invention.
Figure 6:
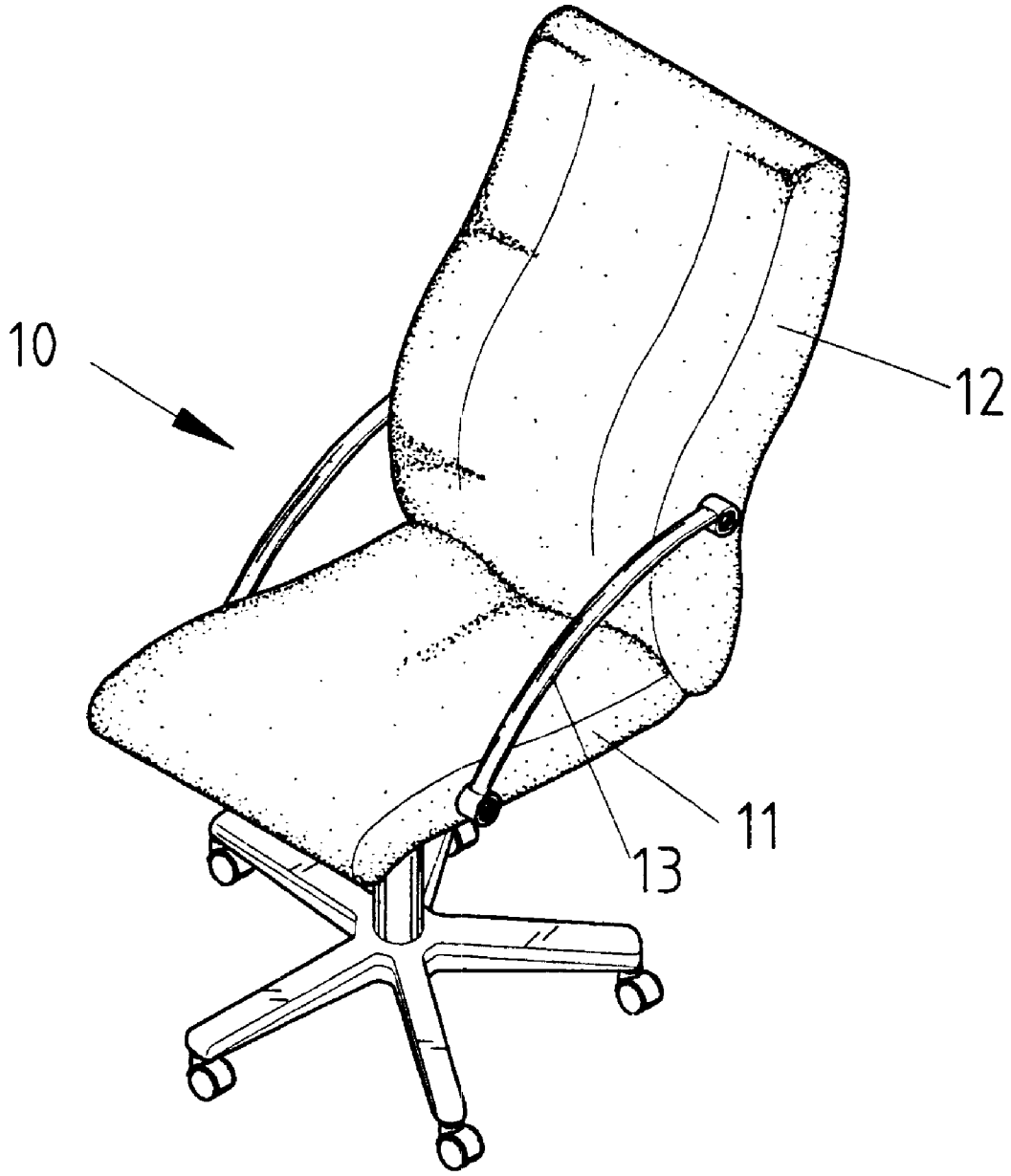
Fig. 6 PRIOR ART
FIG. 6 is a perspective view of a conventional chair.

FIG. 5 illustrates a modified embodiment of the support 30, wherein the first end 311 of the support 30 has two L-shaped members 317 each having a horizontal section securely fixed to an underside of the armrest 20 and a vertical section. The armrest 20 extends through a space between the vertical sections of the L-shaped members 317 of the first end 311 of the support 30. Similar to the first embodiment, the support 30 comprises two parallel connecting beams 318 for connecting the vertical sections of the L-shaped members 317 to the second end 312 of the support 30. The connecting beams 318 extend at a level above the lower front end 21 of the armrest 20. Although not specifically shown, at least one fixed plate is mounted between the connecting beams 318 for supporting the arm pad 40. Again, the arm pad 40 provides a support for the elbows of the user using a computer keyboard or the like, thereby avoiding the risk of sore arms and/or shoulders as a result of long-term typing or the like. In an alternative embodiment, the second end 312 of the support 30 is securely fixed to the upper arcuate face 23 of the armrest 20, and the first end 311 of the support 30 is not necessarily fixed to the armrest 20.

Although the invention has been explained in relation to its preferred embodiment, it is to be understood that many other possible modifications and variations can be made without departing from the scope of the invention as hereinafter claimed.

What is claimed is:

1. A combination of an armrest of a chair and a support assembly, the combination comprising:

an armrest declining forward and having an upper rear end and a lower front end; and a support comprising a rectangular frame having a first end and a second end, the first end of the rectangular frame having a first end portion and a second end portion, the second end of the rectangular frame including a first L-shaped member and a second L-shaped member, the first L-shaped member including a horizontal section securely fixed to the armrest and a vertical section, the second L-shaped member including a horizontal section securely fixed to the armrest and a vertical section, the rectangular frame further including two parallel connecting beams, one of the connecting beams connecting the first end portion of the first end of the rectangular frame to the vertical section of the first L-shaped member, the other connecting beam connecting the second end portion of the first end of the rectangular frame to the vertical section of the second L-shaped member, the connecting beams extending at a level above the lower front end of the armrest, further comprising at least one fixed plate mounted between the connecting beams.

2. The combination as claimed in claim 1, further comprising an arm pad mounted on said at least one fixed plate.

3. The combination as claimed in claim 1, wherein the horizontal section of each of the first L-shaped member and the second L-shaped member is securely fixed to an underside of the armrest.

* * * * *